US006640472B1

(12) United States Patent
Wu

(10) Patent No.: US 6,640,472 B1
(45) Date of Patent: Nov. 4, 2003

(54) STEAM IRON WITH DETACHABLE WATER RESERVOIR

(75) Inventor: Tsan-Kuen Wu, Tainan Hsien (TW)

(73) Assignee: Eupa International Corporation, Las Vegas, NV (US)

( * ) Notice: Subject to any disclaimer, the term of this patent is extended or adjusted under 35 U.S.C. 154(b) by 0 days.

(21) Appl. No.: 10/152,124

(22) Filed: May 21, 2002

(51) Int. Cl.[7] ..... D06F 75/40
(52) U.S. Cl. ..... 38/77.3
(58) Field of Search ..... 38/77.3, 77.6, 38/79, 96, 107, 77.83, 77.8, 77.7, 77.9, 85; 219/242, 246, 254, 259, 247; 68/222

(56) References Cited

U.S. PATENT DOCUMENTS 1,633,568 A * 6/1927 Brewer
4,565,019 A * 1/1986 Cavalli ..... 38/77.6
5,398,434 A * 3/1995 Biancalani ..... 38/77.3
5,832,639 A * 11/1998 Muncan ..... 38/77.6
6,021,591 A * 2/2000 Basile ..... 38/77.6
6,212,332 B1 * 4/2001 Sham et al.

* cited by examiner

*Primary Examiner*—Ismael Izaguirre
(74) *Attorney, Agent, or Firm*—Ladas & Parry

(57) ABSTRACT

A steam iron includes an iron unit, an evaporating unit concealed in a receiving space in a base unit, a water reservoir detachably connected to the base unit, and a pump unit. The evaporating unit includes a housing that confines a steam generating chamber and that is formed with a water inlet. The pump unit is provided for drawing water from the water reservoir into the steam generating chamber via the water inlet.

10 Claims, 7 Drawing Sheets

STEAM IRON WITH DETACHABLE WATER RESERVOIR

BACKGROUND OF THE INVENTION

1. Field of the Invention

The invention relates to a steam iron, more particularly to a steam iron with a detachable water reservoir.

2. Description of the Related Art

Referring to FIGS. 1 and 2, a conventional steam iron 1 is shown to comprise an iron unit 11 with a plurality of steam outlets 111, a base unit 12 formed with a receiving space 121, an evaporating unit 13 installed fixedly in the receiving space 121, a metallic relief valve 14 mounted on the evaporating unit 13, and a connecting tube 15 interconnecting the evaporating unit 13 and the iron unit 11. The evaporating unit 13 includes a housing 132 that defines a steam generating chamber 131, a heating unit 133 installed on a bottom portion of the housing 132, a hollow tube 135 threadedly connected to a top portion of the housing 132, and a steam port 136 that is formed through the housing 132 and that is in fluid communication with the steam generating chamber 131. The tube 135 has a water inlet 134 that is in fluid communication with the steam generating chamber 131. The relief valve 14 is threadedly connected to the tube 135. The connecting tube 15 is disposed above and is in fluid communication with the steam port 136. The iron unit 11 further includes a steam switch 112, which can be pressed to control the release of steam from the steam outlets 111.

In use, the relief valve 14 is rotatably opened to permit filling of water into the steam generating chamber 131 via the water inlet 134 in the tube 135. The heating unit 133 is activated after the relief valve 14 is threadedly mounted on the threaded tube 135 to vaporize the water in the steam generating chamber 131. When steam is needed, the steam switch 112 is pressed such that the steam flows from the steam port 136 into the iron unit 11 via the connecting tube 15, thereby exiting from the steam outlets 111.

The following are some of the drawbacks of the conventional steam iron 1:

1. The entire steam iron 1 has to be moved to a water source for refilling of water into the steam generating chamber 131, there by making the steam iron 1 inconvenient to use.

2. Because the volume of the steam generating chamber 131 is relatively large, it is time-consuming to vaporize the water in the steam generating chamber 131. Furthermore, when water is refilled into the steam generating chamber 131, the temperature of the evaporating unit 13 is lowered, thereby prolonging the heating time.

3. Since steam is accumulated in the evaporating unit 13 and is released through the relief valve 14, the temperature of the relief valve 14 is relatively high. When the relief valve 14 is opened in order to fill water into the steam generating chamber 131, the high-temperature relief valve 14 can cause injury, such as scalding, to the user. The conventional steam iron 1 is thus unsafe.

4. It is not possible to view the remaining water in the evaporating unit 13 for timely replenishing of water since the evaporating unit 13 is installed inside the base unit 12. As such, the evaporating unit 13 is easily burned, thereby rendering the conventional steam iron 1 dangerous to use.

SUMMARY OF THE INVENTION

Therefore, the main object of the present invention is to provide a steam iron with a detachable water reservoir that is capable of overcoming the aforementioned drawbacks of the prior art.

According to this invention, a steam iron comprises an iron unit, a base unit, an evaporating unit, a water reservoir, a pump unit, and a connecting tube. The iron unit includes a sole plate and a plurality of steam outlets in the soleplate. The base unit has a receiving space defined therein. The evaporating unit is concealed in the receiving space in the base unit, and includes a thermally conductive housing that confines a steam generating chamber, and a heating unit for heating the housing. The housing is formed with a water inlet and a steam port that is in fluid communication with the steam generating chamber. The water reservoir is detachably connected to the base unit. The pump unit is provided for drawing water from the water reservoir into the steam generating chamber via the water inlet. The connecting tube interconnects the evaporating unit and the iron unit so that the steam outlets in the iron unit are in fluid communication with the steam port in the evaporating unit, thereby permitting discharge of the steam from the steam outlets in the iron unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
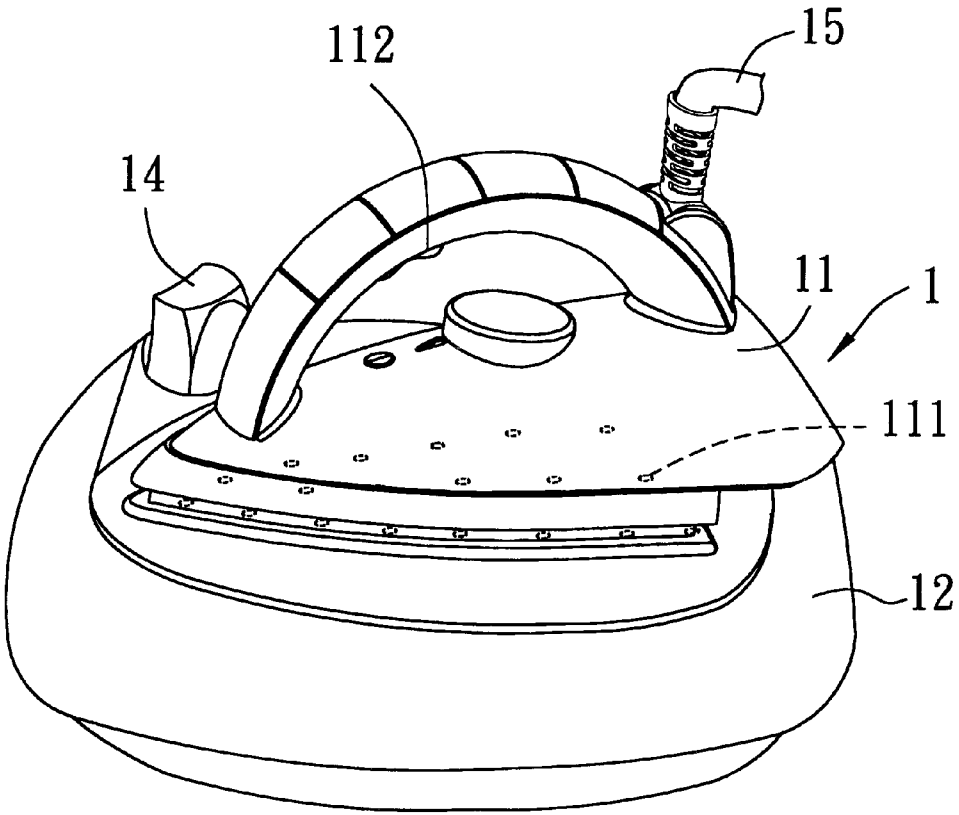
FIG. 1 PRIOR ART
FIG. 1 is a perspective view of a conventional steam iron.
Figure 2:
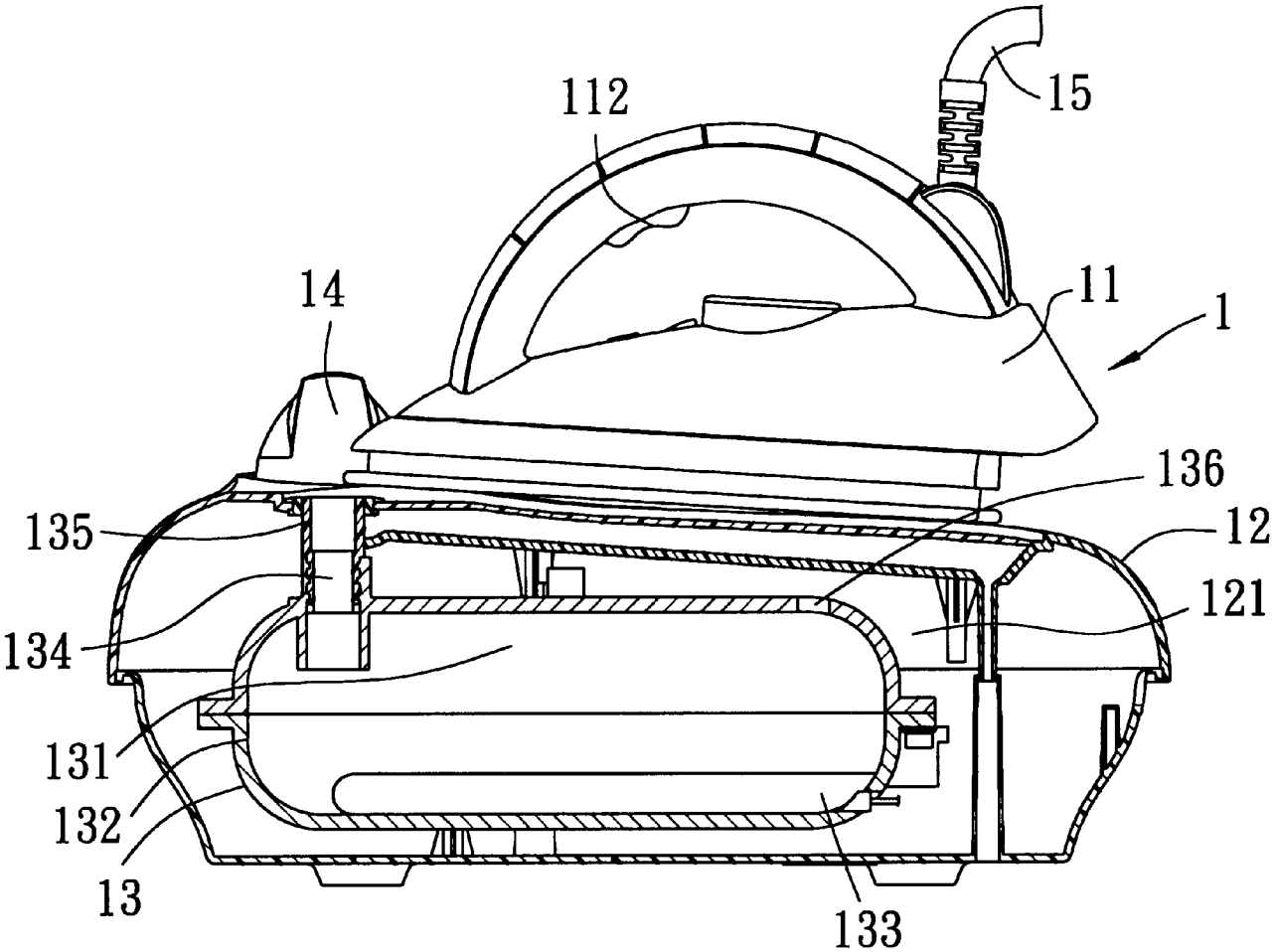
FIG. 2 PRIOR ART
FIG. 2 is a partly sectional schematic view of the steam iron of FIG. 1.

Referring to FIGS. 3 to 7, the preferred embodiment of a steam iron 100 according to the present invention is shown to comprise an iron unit 6, a base unit 2, an evaporating unit 3, a water reservoir 4, a pump unit 5, and a connecting tube 7.

The iron unit 6 includes a main body 63, a soleplate 64 installed on a bottom portion of the main body 63, a plurality of steam outlets 61 formed in the soleplate 64, and a handle 65. The handle 65 is provided with a water-filling switch 62.

The base unit 2 is disposed in front of the water reservoir 4, and has a stop unit 225 and a water port 224 that is in fluid communication with the pump unit 5. The base unit 2 further has an upper base portion 211, a lower base portion 212 that is connected removably to the upper base portion 211 and that cooperates with the upper base portion 211 so as to define a receiving space 214 therebetween, and a connecting piece 22 that includes a vertical plate 221, a surrounding wall 222, and an end wall 223. The vertical plate 221 is fixed between the upper and lower base portions 211, 212. The surrounding wall 222 extends integrally and forwardly from the vertical plate 221, and has a front end. The water port 224 is formed through the surrounding wall 222. The end wall 223 has an outer periphery that is formed integrally with the front end of the surrounding wall 222 so as to close the front end of the surrounding wall 222. The stop unit 225, in this embodiment, is formed as a pair of spaced-apart upper and lower curved protrusions, and extends integrally and rearwardly from the end wall 223, as best illustrated in FIG. 5. The base unit 2 further has an upper wall 23 and a lower wall 24 that extend respectively, horizontally, and rearwardly from the upper and lower base portions 211, 212. The upper wall 23 is disposed over and is spaced apart from the lower wall 24 so as to define a receiving groove 25 therebetween (see FIG. 4), into which the water reservoir 4 is inserted. The lower wall 24 is formed with an integral retaining hook 241 that extends upward from a rear end thereof.

The base unit 2 is provided with an ironing switch 26 that is adapted to be electrically connected to a power plug 8 so as to heat the iron unit 6 in a known manner.

Figure 3:
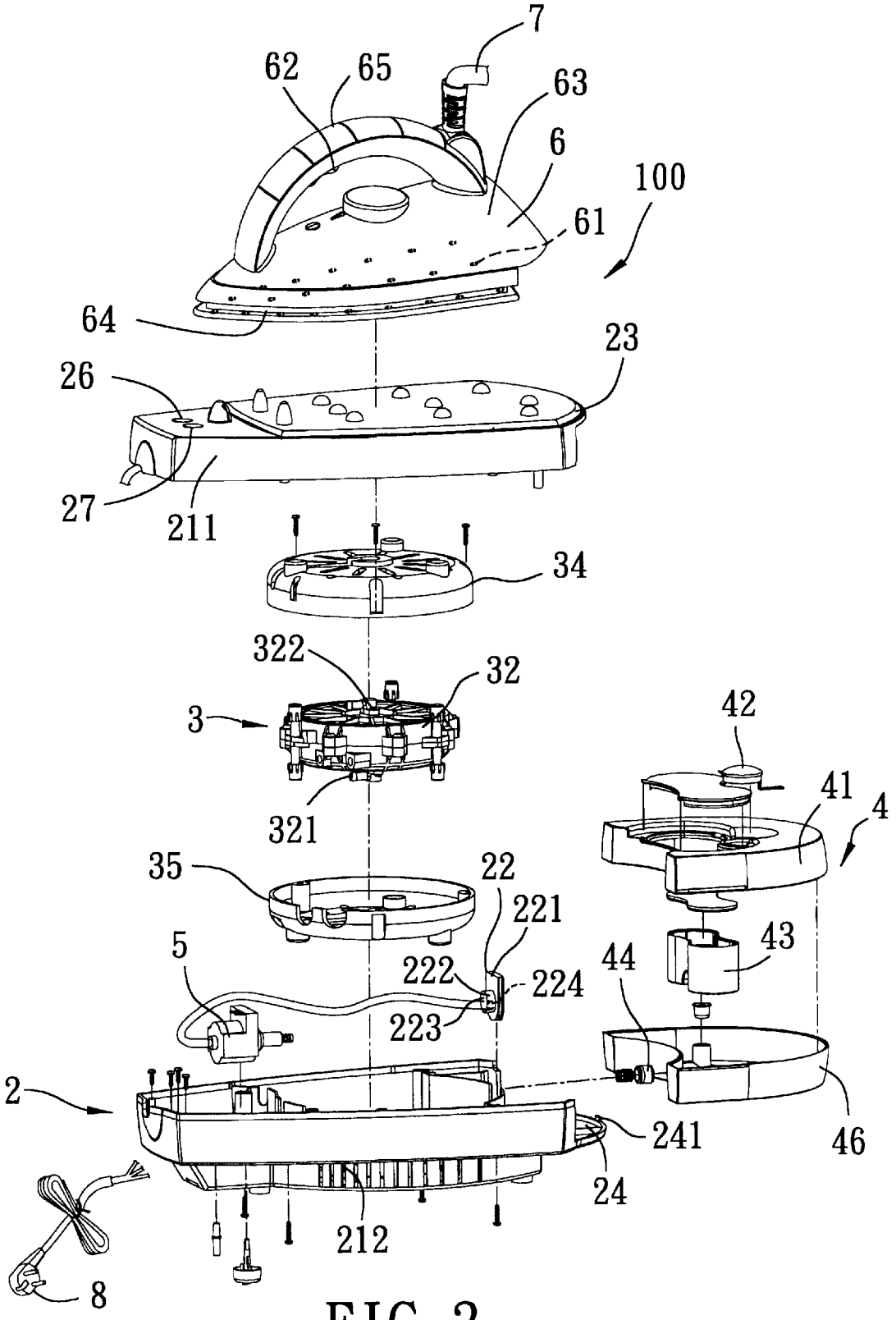
FIG. 3 is a partly exploded perspective view of the preferred embodiment of a steam iron according to the present invention.
Figure 4:
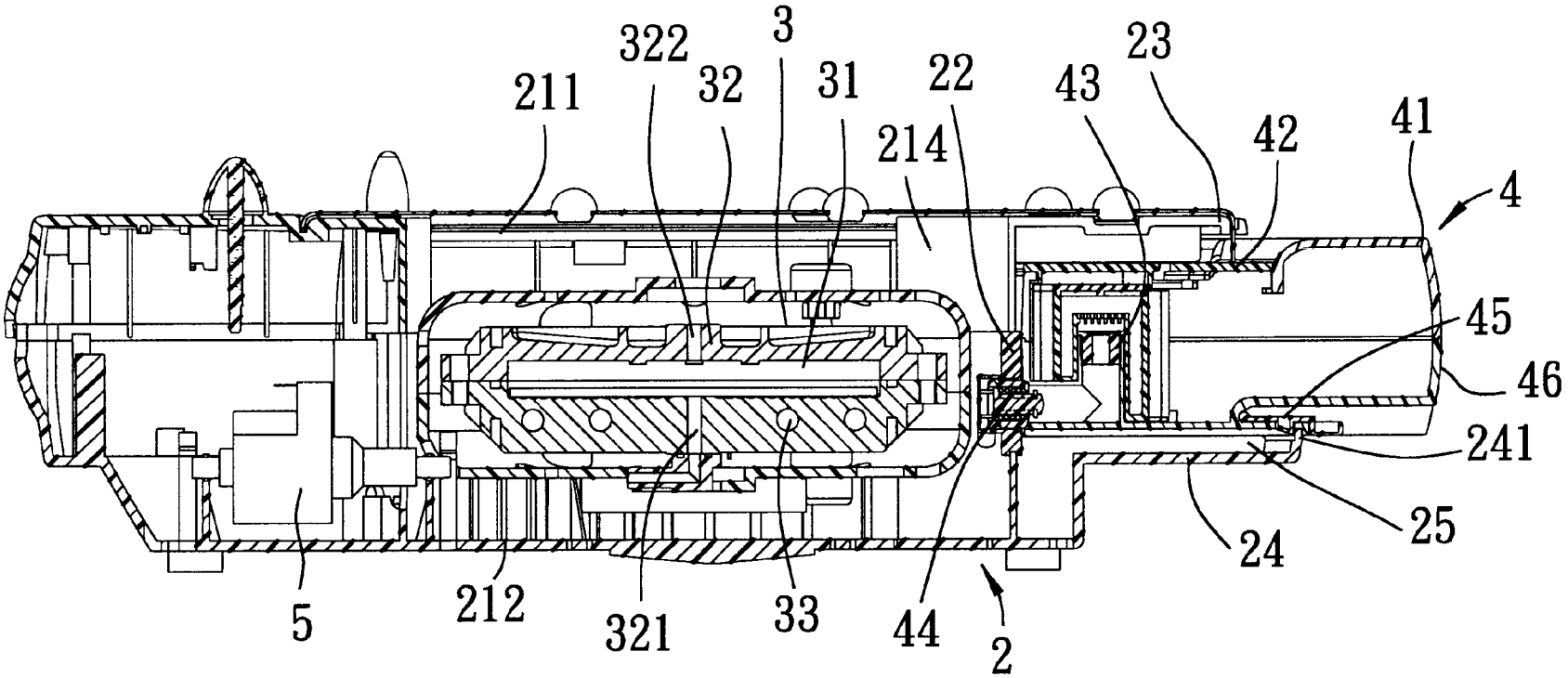
FIG. 4 is a sectional view of the preferred embodiment.
Figure 5:
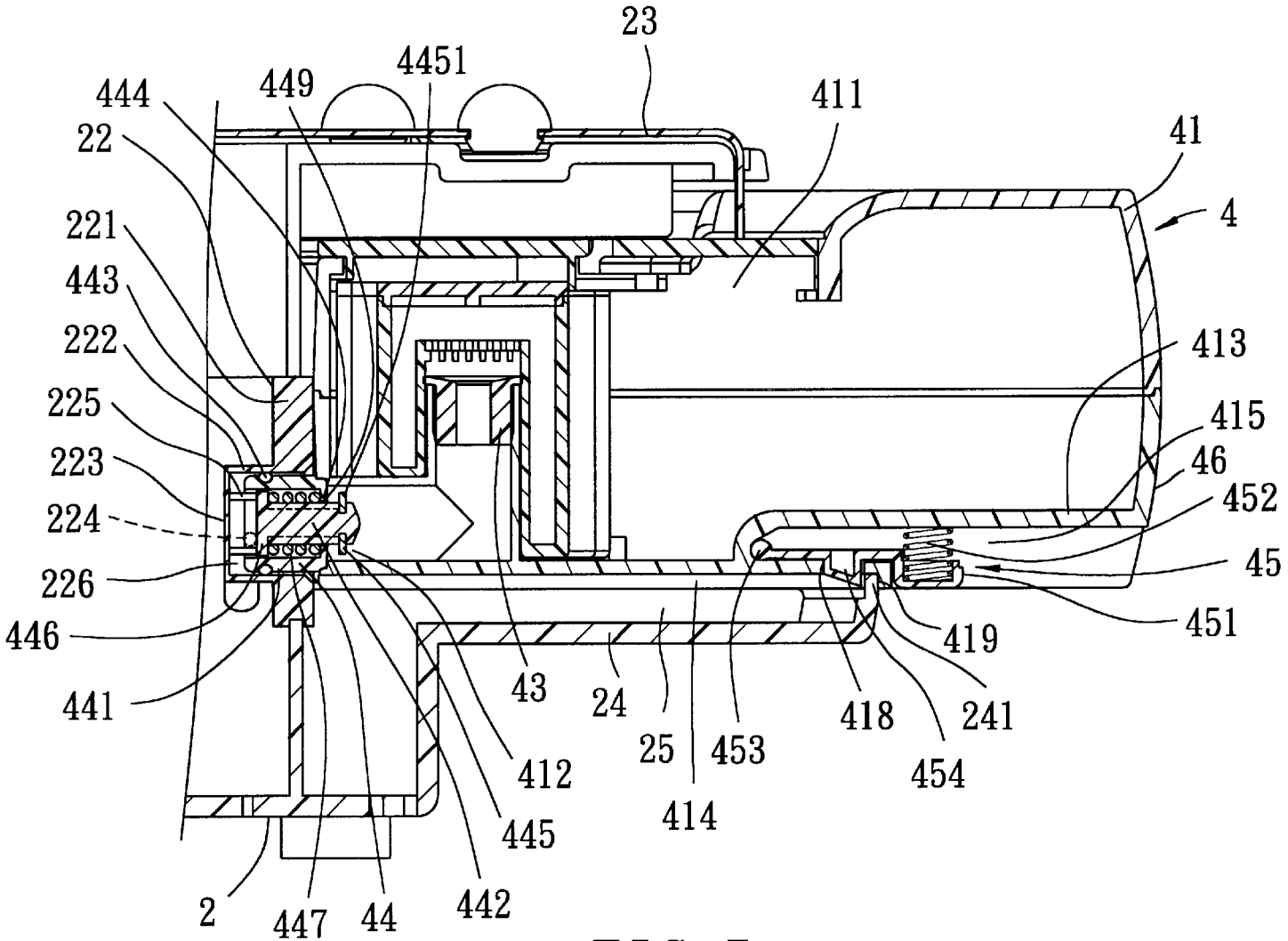
FIG. 5 is a fragmentary sectional view of the preferred embodiment, illustrating how a water reservoir is detachably connected to a base unit.
Figure 6:
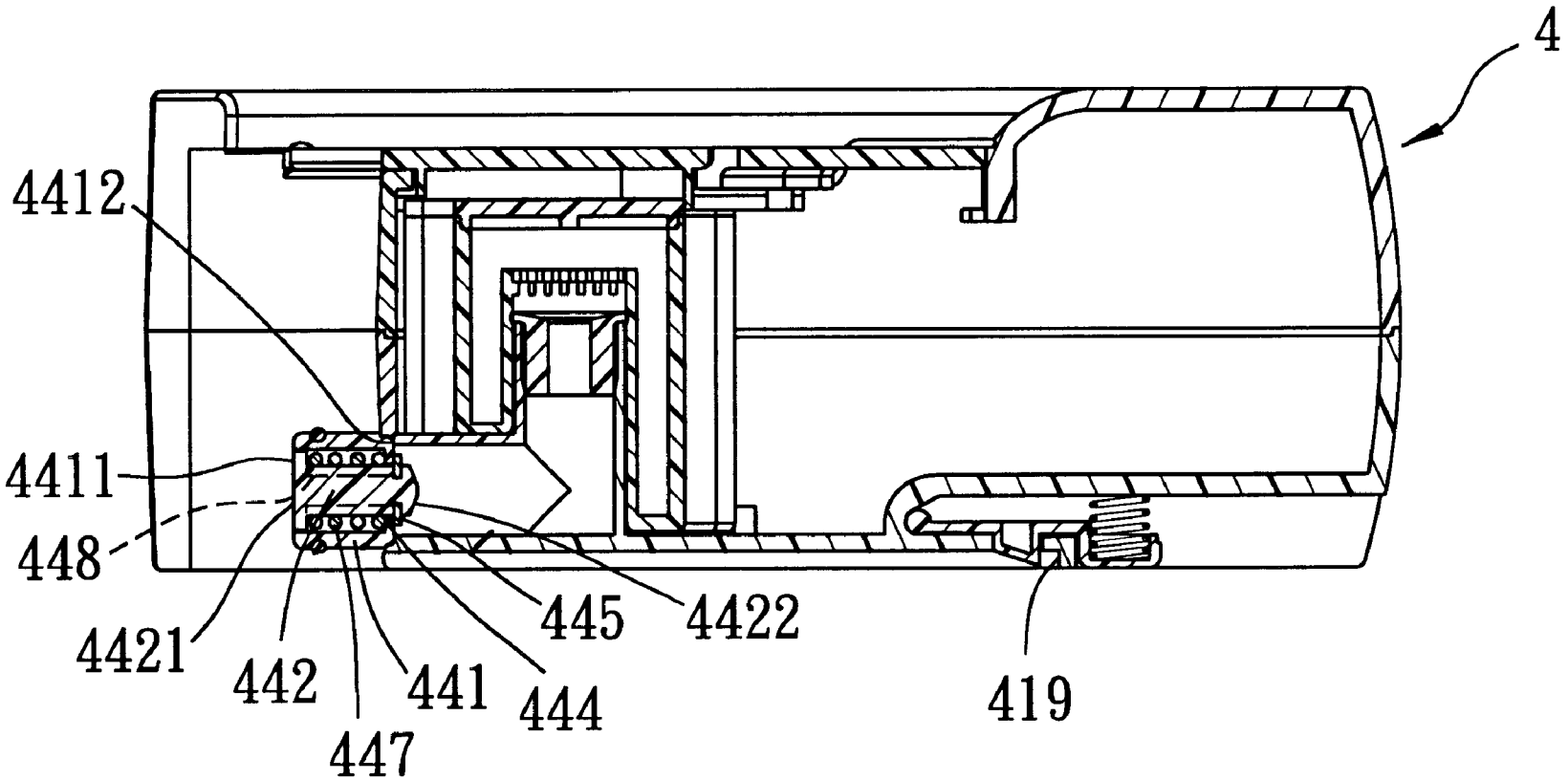
FIG. 6 is a sectional view of the water reservoir after it is detached from the base unit.
Figure 7:
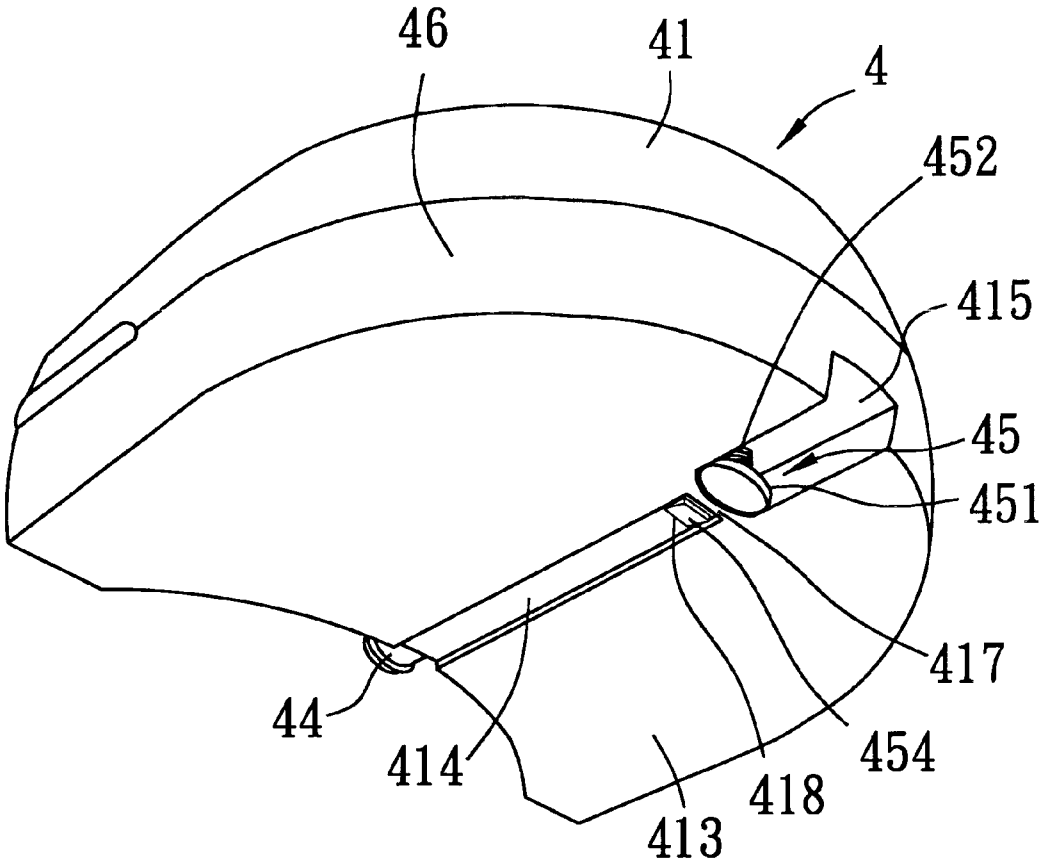
FIG. 7 is a perspective view of a bottom portion of the water reservoir, illustrating the front and rear slots in its bottom surface.

The evaporating unit 3 is fastened to outer top and bottom covers 34, 35 by means of screws, and is concealed in the receiving space 214 in the base unit 2 (see FIGS. 3 and 4). The evaporating unit 3 includes a thermally conductive housing 32 that confines a steam generating chamber 31, and a heating unit 33 for heating the housing 32. The housing 32 is formed with a water inlet 321 and a steam port 322 that is in fluid communication with the steam generating chamber 31.

The base unit 2 is further provided with an evaporating switch 27 that is adapted to be electrically connected to the power plug 8 so as to activate the heating unit 33 of the evaporating unit 3 and that is adjacent to the ironing switch 26.

The water reservoir 4 is detachably connected to the base unit 2, and includes a receptacle body consisting of upper and lower halves 41, 46, a cap 42, an ion exchange resin unit 43, a water valve 44, and a retention unit 45 (see FIGS. 3 and 5). The upper and lower halves 41, 46 are made of a transparent material such that water in the water reservoir 4 is visible via the transparent material so as to permit timely replenishing of water into the water reservoir 4. The upper half 41 includes a water-implementing opening 411. The lower half 46 includes a water outlet 412. The cap 42 is connected removably to the upper receptacle body 41 for covering the water-implementing opening 411. The ion exchange resin unit 43 is disposed between the upper and lower halves 41, 46, and is provided to purify water in the water reservoir 4. The water valve 44 is disposed within the water outlet 412 so as to seal the water outlet 412 when the water reservoir 4 is detached from the base unit 2, and is constructed as a poppet valve, which includes a tubular sleeve 441, a valve rod 442, a valve 445, a front spring 447, and an O-ring 443.

The tubular sleeve 441 of the water valve 44 is connected removably to the base unit 2 so that the water outlet 412 in the water reservoir 4 is in fluid communication with the water port 224 in the base unit 2. The sleeve 441 has a rear end valve hole 449, a front end 4411 that is inserted in to a space 226 defined between the stop unit 225 and the surrounding wall 222, and a rear end 4412 (see FIG. 6) that is formed with a radially and inwardly extending flange 444 for defining the valve hole 449 (see FIG. 5).

The valve rod 442 is disposed movably within the sleeve 441, and has a front end 4421 that abuts against the stop unit 225, a rear end 4422, a diameter that is slightly smaller than that of the valve hole 449 in the sleeve 441, a front end flange 446 that extends integrally, radially, and outwardly from the front end 4421 of the valve rod 442, and an annular surface that is formed with a plurality of axially extending slots 448, each of which has two closed ends.

The valve 445, in this embodiment, includes a retaining ring 4451 that is sleeved fixedly around the rear end 4422 of the valve rod 442, and is spaced apart from the valve hole 449 in the sleeve 441 so as to permit water flow from the water outlet 412 in the water reservoir 4 into the water port 224 in the base unit 2 via the sleeve 441 when the water reservoir 4 is connected removably to the base unit 2, as best illustrated in FIG. 5.

The front spring 447 is a coiled compression spring that is sleeved on the valve rod 442 between the front end flange 446 of the valve rod 442 and the flange 444 of the sleeve 441 and that is compressed when the water reservoir 4 is connected removably to the base unit 2. Accordingly, when the water reservoir 4 is removed from the base unit 2, the front spring 447 can bias the valve rod 442 forward within the sleeve 441 such that the retaining ring 4451 presses against the flange 444 at the sleeve 441 so as to engage the valve 445 with the valve hole 449 in the sleeve 441, thereby preventing discharge of water from the water reservoir 4 via the water outlet 412.

The O-ring 443 is disposed between the surrounding wall 222 of the connecting piece 22 and the sleeve 441, and is behind the water port 224 in the surrounding wall 222 so as to establish a liquid-tight seal between the surrounding wall 222 and the sleeve 441.

The water reservoir 4 further has a bottom surface 413, and a rear end wall 419 (see FIG. 5). The bottom surface 413 includes a front slot 414 with a closed rear end, a rear slot 415 with a closed front end that is disposed over the rear end of the front slot 414, and a partition 417 that is disposed between the front end of the rear slot 415 and the rear end of the front slot 414 and that is formed with a hole 418 therethrough that is communicated with the front and rear slots 414, 415. The rear end wall 419 defines the closed rear end of the front slot 414.

The retention unit 45 retains the water reservoir 4 on the base unit 2, and includes a pushbutton 451 that is mounted movably on the bottom surface 413 of the water reservoir 4, and a rear spring 452 that is disposed between the pushbutton 451 and the bottom surface 413 of the reservoir 4 so as to bias the pushbutton 451 downward. The pushbutton 451 is formed with an integral positioning rod portion 453 that extends forward therefrom into the front end of the rear slot 415 and that has a front end, about which the positioning rod portion 453 is rotatable within the rear slot 415, and an integral insert portion 454 that is disposed behind the positioning rod portion 453, that is inserted into the hole 418 in the partition 417, and that extends downward from the hole 418 in the partition 417 so as to confine the retaining hook 241 of the lower wall 24 between the insert portion 454 and the rear end wall 419, thereby retaining the water reservoir 4 on the base unit 2. When the pushbutton 451 is pressed upward so as to release the retaining hook 241 from the water reservoir 4, the insert portion 454 is retracted into the hole 418 in the partition 417, thereby permitting removal of the water reservoir 4 from the base unit 2.

When the water reservoir 4 is installed on the base unit 2, the water valve 44 is activated to open the water outlet 412 so as to permit water flow from the water outlet 412 into the pump unit 5.

The pump unit 5 is disposed in the receiving space 214 in the base unit 2, and is electrically connected to the water-filling switch 62 of the iron unit 6 so as to draw the water from the water reservoir 4 into the steam generating chamber 31 via the water inlet 321 when the water-filling switch 62 is activated.

The connecting tube 7 interconnects the evaporating unit 3 and the iron unit 6 so that the steam outlets 61 in the iron unit 6 are in fluid communication with the steam port 322 in the evaporating unit 3, thereby permitting discharge of the steam from the steam outlets 61 in the iron unit 6.

In use, after the water reservoir 4 is installed in the receiving groove 25 in the base unit 2, the water valve 44 is coupled with the connecting piece 22 of the base unit 2 by inserting the tubular sleeve 441 into the space 226 between the stop unit 225 and the surrounding wall 222 of the connecting piece 22. At this time, the valve rod 442 is pushed by the stop unit 225 to separate from the flange 444 of the sleeve 441, thereby permitting water flow from the water outlet 412 into the water port 224 in the base unit 2. The ironing switch 26 and the evaporating switch 27 are then switched on so as to activate the iron unit 6 and the heating unit 33. When steam is desired, the water-filling switch 62 is pressed to activate the pump unit 5. The water is drawn from the water reservoir 4 into the steam generating chamber 31 via the water inlet 321 for generation of steam. The generated steam then flows through the steam port 322, the connecting tube 7, and the iron unit 6, and exits from the steam outlets 61.

To detach the water reservoir 4 from the base unit 2, the pushbutton 451 is pressed such that the insert portion 454 of the retention unit 45 retracts into the hole 418 in the partition 417 so as to release the retaining hook 241 of the base unit 2 from the water reservoir 4, thereby permitting removal of the water reservoir 4 from the base unit 2. When the water reservoir 4 is removed from the base unit 2, the tubular sleeve 441 of the water valve 44 separates from the connecting piece 22 of the base unit 2. At this time, the front spring 447 biases the valve rod 442 forward within the sleeve 441 so that the valve 445 engages the valve hole 449 in the sleeve 441. As such, water from the water reservoir 4 is prevented from discharging via the water outlet 412.

The advantages of the steam iron 100 of the present invention can be summarized as follows:

1. Since the water reservoir 4 can be detached from the base unit 2, water can be refilled conveniently into the water reservoir 4.

2. Water can be quickly evaporated to form steam since the volume of the evaporating unit 3 is comparatively small.

3. The steam iron 100 is safe to use since steam does not accumulate in the evaporating unit 3 but flows directly out of the steam iron 100 such that a relief valve is not required.

4. Timely replenishing of water into the water reservoir 4 is possible since the receptacle body of the water reservoir 4 is made of a transparent material. As such, burning of the evaporating unit 3 is not likely to occur. Thus, the steam iron 100 is safe and convenient to use.

5. Water ports are not easily blocked due to the presence of the ion exchange resin unit 43 within the water reservoir 4.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A steam iron comprising:

an iron unit including a soleplate and a plurality of steam outlets in said soleplate;

a base unit having a receiving space defined therein;

an evaporating unit concealed in said receiving space in said base unit and including a thermally conductive housing that confines a steam generating chamber, and a heating unit for heating said housing, said housing being formed with a water inlet and a steam port that is in fluid communication with said steam generating chamber;

a water reservoir detachably connected to said base unit;

a pump unit for drawing water from said water reservoir into said steam generating chamber via said water inlet; and a connecting tube interconnecting said evaporating unit and said iron unit so that said steam outlets in said iron unit are in fluid communication with said steam port in said evaporating unit, thereby permitting discharge of the steam from said steam outlets in said iron unit;

wherein said water reservoir includes a hollow receptacle body with a water outlet, and a water valve disposed within said water outlet so as to seal said water outlet, said water valve being activated to open said water outlet when said water reservoir is installed on said base unit so as to permit water flow from said water reservoir is installed on said base unit so as to permit water flow from said water outlet into said pump unit; and wherein said base unit has a stop unit and a water port that is in fluid communication with said pump unit, said water valve being constructed as a poppet valve, and including:

a tubular sleeve connected removably to said base unit so that said water outlet in said water reservoir is in fluid communication with said water port in said base unit, said sleeve having a rear end valve hole;

a valve rod disposed movably within said sleeve and having a front end that abuts against said stop unit, and a rear end;

a valve connected fixedly to said rear end of said valve rod and spaced apart from said valve hole in said sleeve so as to permit water flow from said water outlet in said water reservoir into said water port in said base unit via said sleeve; and a front spring for biasing said valve rod forward within said sleeve so that said valve seals said valve hole in said sleeve when said water reservoir is removed from said base unit, thereby preventing discharge of water from said water reservoir via said water outlet.

2. The steam iron as claimed in claim 1, wherein said stop unit includes a pair of spaced-apart upper and lower curved protrusions.

3. The steam iron as claimed in claim 1, wherein said receptacle body of said water reservoir is made of a transparent material such that water in said water reservoir is visible via said transparent material so as to permit timely replenishing of water into said water reservoir.

4. The steam iron as claimed in claim 1, wherein said water reservoir further includes an ion exchange resin unit to purify water in said water reservoir.

5. The steam iron as claimed in claim 1, wherein said hollow receptacle body includes a water-implementing opening, said water reservoir further including a cap that is connected removably to said receptacle body for covering said water-implementing opening.

6. The steam iron as claimed in claim 1, wherein said iron unit further includes a handle, on which a water-filling switch is provided, said water-filling switch being electrically connected to said pump unit so as to draw the water into said steam generating chamber via said water inlet when said water-filling switch is activated.

7. The steam iron as claimed in claim 1, wherein said base unit is disposed in front of said water reservoir, and further has an upper base portion, a lower base portion that is connected removably to said upper base portion, and a connecting piece that includes:

a vertical plate fixed between said upper and lower base portions;

a surrounding wall extending integrally and forwardly from said vertical plate and having a front end, said water port being formed through said surrounding wall; and an end wall having an outer periphery that is formed integrally with said front end of said surrounding wall so as to close said front end of said surrounding wall, said stop unit extending integrally and rearwardly from said end wall;

said sleeve having a front end that is inserted into a space defined between said stop unit and said surrounding wall, and a rear end that is formed with a radially and inwardly extending flange for defining said valve hole therein;

said valve rod having a diameter that is slightly smaller than that of said valve hole in said sleeve, a front end flange that extends integrally, radially, and outwardly from said front end of said valve rod, and an annular surface that is formed with a plurality of axially extending slots, each of which has two closed ends;

said valve including a retaining ring that is sleeved fixedly around said rear end of said valve rod and that is biased by said front spring to press against said flange of said sleeve when said water reservoir is removed from said base unit, thereby sealing said valve hole in said sleeve;

said front spring being constructed as a coiled compression spring that is sleeved on said valve rod between said front end flange of said valve rod and said flange of said sleeve and that is compressed when said water reservoir is connected removably to said base unit.

8. The steam iron as claimed in claim 7, wherein said water valve includes an O-ring that is disposed between said surrounding wall of said connecting piece and said sleeve and behind said water port in said surrounding wall so as to establish a liquid-tight seal between said surrounding wall and said sleeve.

9. The steam iron as claimed in claim 7, wherein said water reservoir includes a retention unit that retains said water reservoir on said base unit.

10. The steam iron as claimed in claim 9, wherein said base unit further has an upper wall and a lower wall that extend respectively, horizontally, and rearwardly from said upper and lower base portions, said upper wall being disposed over and being spaced apart from said lower wall so as to define a receiving groove therebetween, into which said water reservoir is inserted, said lower wall being formed with an integral retaining hook that extends upward from a rear end thereof, said water reservoir having a bottom surface, which includes a front slot with a closed rear end, a rear slot with a closed front end that is disposed over said rear end of said front slot, and a partition that is disposed between said front end of said rear slot and said rear end of said front slot and that is formed with a hole therethrough that is communicated with said front and rear slots, and a rear end wall that defines said closed rear end of said front slot, said retention unit including a pushbutton that is mounted movably on said bottom surface of said water reservoir, and a rear spring that is disposed between said pushbutton and said bottom surface of said reservoir so as to bias said pushbutton downward, said pushbutton being formed with an integral positioning rod portion that extends forward therefrom into said front end of said rear slot and that has a front end, about which said positioning rod portion is rotatable within said rear slot, and an integral insert portion that is disposed behind said positioning rod portion, that is inserted into said hole in said partition, and that extends downward from said hole in said partition so as to confine said retaining hook of said lower wall between said insert portion and said rear end wall, thereby retaining said water reservoir on said base unit, said insert portion being retracted into said hole in said partition when said pushbutton is pressed upward so as to release said retaining hook from said water reservoir, thereby permitting removal of said water reservoir from said base unit.

* * * * *